US012428860B1

(12) United States Patent
Bancroft

(10) Patent No.: US 12,428,860 B1
(45) Date of Patent: Sep. 30, 2025

(54) ATTACHMENT DEVICE AND SUPPORT SYSTEM FOR A ROOF JACK

(71) Applicant: Russell N. Bancroft, Simi Valley, CA (US)

(72) Inventor: Russell N. Bancroft, Simi Valley, CA (US)

( * ) Notice: Subject to any disclaimer, the term of this patent is extended or adjusted under 35 U.S.C. 154(b) by 67 days.

(21) Appl. No.: 18/387,425

(22) Filed: Nov. 6, 2023

Related U.S. Application Data

(60) Provisional application No. 63/383,307, filed on Nov. 11, 2022.

(51) Int. Cl.
*E04G 3/22* (2006.01)

(52) U.S. Cl.
CPC ..... *E04G 3/22* (2013.01)

(58) Field of Classification Search
CPC .. E04G 3/26; E04G 3/22; E04G 3/265; E04G 21/3214; E04G 21/328; E04G 5/04; E04G 5/041; E04G 5/048; F24S 25/00; F24S 25/30; F24S 25/33; F24S 25/35; H02S 20/23; H02S 20/24
USPC ..... 248/237, 48.1, 148, 536, 235, 241, 243, 248/247, 248; 182/45, 99
See application file for complete search history.

(56) References Cited

U.S. PATENT DOCUMENTS 2,708,543 A * 5/1955 Matich ..... E06C 7/081 182/196
3,866,715 A * 2/1975 Foulk ..... E04G 3/26 248/237
5,513,826 A * 5/1996 Lebaron ..... E04D 15/02 248/237
6,045,102 A * 4/2000 Terenzoni ..... E04G 5/06 248/237
6,220,390 B1 * 4/2001 Pike ..... E04G 3/26 248/237
6,470,646 B1 * 10/2002 Bryant ..... E04G 3/28 52/749.12
6,698,702 B2 * 3/2004 Macri ..... E04G 3/26 248/237
7,509,702 B2 * 3/2009 Cantis ..... E04G 5/041 256/65.01
8,104,575 B1 1/2012 Bancroft
8,418,419 B1 * 4/2013 Aseere ..... F24S 25/33 52/173.3
8,505,685 B1 * 8/2013 Rayfield ..... E04G 5/041 52/749.12
(Continued)

*Primary Examiner* — Eret C McNichols
(74) *Attorney, Agent, or Firm* — Minta Law Group LC; Veronica-Adele R. Cao

(57) ABSTRACT

An attachment device and support system for a roof jack. The attachment device has a hook end that is inserted into an opening at one end of the support platform and a friction fit is formed between the hook end of the attachment device and the opening of the support platform. The attachment device also has two side walls where the width of a gap between the sidewalls equals the width of a vertical cross-member of the support platform, creating a friction fit between the sidewalls of the attachment device and the vertical crossmember of the support platform. When the hook end of the attachment device is coupled to the opening the support platform, the flat end of the attachment device also creates a friction fit between it and the next adjacent horizontal crossmember. A roof jack mount is coupled to the front wall of the attachment device.

20 Claims, 12 Drawing Sheets

(56) References Cited

U.S. PATENT DOCUMENTS

| | | | | |
|---|---|---|---|---|
| 8,776,948 | B2 * | 7/2014 | Svehlek | E06C 7/50 182/112 |
| 8,783,415 | B2 | 7/2014 | Bancroft | |
| 9,145,687 | B1 | 9/2015 | Bancroft | |
| 9,187,914 | B2 * | 11/2015 | Lallier | E04G 21/3285 |
| 9,273,515 | B2 * | 3/2016 | O'Grady, Sr. | E06C 1/345 |
| 11,085,238 | B1 | 8/2021 | Bancroft | |
| 11,728,762 | B2 * | 8/2023 | Nickerson | F24S 25/65 136/244 |
| 2003/0042377 | A1 * | 3/2003 | Macri | E04G 3/265 248/237 |
| 2004/0051017 | A1 * | 3/2004 | Mislich | E04G 3/26 248/51 |
| 2006/0059858 | A1 * | 3/2006 | Layman | E04D 15/02 52/749.12 |
| 2007/0034449 | A1 * | 2/2007 | Leendertse | E04G 3/26 182/45 |
| 2012/0061179 | A1 * | 3/2012 | English | E06C 7/48 182/129 |
| 2012/0267193 | A1 * | 10/2012 | Fontaine | E04G 5/041 182/230 |
| 2015/0211246 | A1 * | 7/2015 | Sutherland | E04G 3/265 248/237 |
| 2022/0056714 | A1 * | 2/2022 | Kain | E04G 3/26 |
| 2023/0139449 | A1 * | 5/2023 | Pozgay | E06C 1/39 182/20 |

* cited by examiner

ATTACHMENT DEVICE AND SUPPORT SYSTEM FOR A ROOF JACK

CROSS-REFERENCE TO RELATED APPLICATION

This application claims the benefit of U.S. Provisional Application No. 63/383,307, filed on Nov. 11, 2022 and titled ATTACHMENT DEVICE AND SUPPORT SYSTEM FOR A ROOF JACK. The entire contents of the foregoing are incorporated herein by reference.

FIELD OF THE INVENTION

The present invention relates generally to the field of construction. More specifically, the present invention is an improved attachment device and system that allows a roof jack to be coupled to any type of roof so that an individual may access, ascend, and descend the sloped and elevated roof surfaces of residential and commercial structures.

BACKGROUND OF THE INVENTION

Roof jacks are metal devices that are used to create a stable platform for a person to stand on while working on a roof. Typically, individual roof jacks are nailed into the rafters which are located beneath the sheathing of the roof. Several roof jacks are spaced apart across the roof area where the work is being done. Once all of the roof jacks are secured to the rafters, wooden planks or roof ladders are then secured to the roof jacks, thus providing flat stable surfaces on which the individual may stand.

Currently, roof jacks may only be used on roofs constructed of composition shingle or slate. Typical roof jacks cannot be mounted on roofs made of clay tile or cement tile because nailing the roof jack into the clay tile or cement tile will cause the clay tile or cement tile to crack. Roof jacks also cannot be mounted on metal tile because the nails used to mount the roof jack may not penetrate the metal tile properly. Roof jacks also cannot be mounted to raised metal seam roofs because the curvature of the raised metal seem roofs prevent the roof jack from lying flat against the roof for proper attachment. The present invention, therefore provides an attachment device and support system that allows the standard roof jack to be mounted on any type of roof, including composition shingle, slate, clay tile, cement tile, metal tile, and raised metal seam roofs.

SUMMARY OF THE INVENTION

This summary is provided to introduce a selection of concepts in a simplified form that are further described below in the DETAILED DESCRIPTION OF THE INVENTION. This summary is not intended to identify key features of the claimed subject matter, nor is it intended to be used as an aid in determining the scope of the claimed subject matter.

In accordance with one embodiment of the present invention, a roof jack attachment device for use with a support platform is disclosed. The attachment device comprises: a body; a hook end disposed at one end of the body; a flat end disposed at an opposite end of the body; and a roof jack mount coupled to the body.

In accordance with another embodiment of the present invention, roof jack attachment device for use with a support platform is disclosed. The attachment device comprises: an elongated body; a J-shaped hook end disposed at one end of the body; a T-shaped flat end disposed at an opposite end of the body; and a roof jack mount coupled to the body. The support platform has a rectangular shape and comprises: a top surface; a bottom surface with a resilient pad coupled thereto; two oppositely disposed long sides; two oppositely disposed short ends; and at least one opening formed through the support platform, the opening positioned proximate one short end, wherein the opening is dimensioned to receive and secure the J-shaped hook end of the attachment device.

In accordance with another embodiment of the present invention, a support system for a roof jack is disclosed. The support system comprises: an attachment device comprising: an elongated body; a J-shaped hook end disposed at one end of the body; a T-shaped flat end disposed at an opposite end of the body; and a roof jack mount coupled to the body. The support platform has a rectangular shape and comprises: a top surface; a bottom surface with a resilient pad coupled thereto; two oppositely disposed long sides; two oppositely disposed short ends; four horizontal crossmembers formed on the top surface of the support platform, the horizontal crossmembers extending from an interior surface of one side of the support platform to an interior surface of the other side of the support platform; one vertical crossmember formed on the top surface of the support platform, the vertical crossmember extending from one horizontal crossmember proximate one end of the support platform to another horizontal crossmember proximate the other end of the support platform; six recessed areas on the top surface of the support platform, six recessed areas formed by the four horizontal crossmembers and the vertical crossmember together; and at least one opening formed through one horizontal crossmember that is positioned proximate one short end, wherein the opening is dimensioned to receive and secure the J-shaped hook end of the attachment device, wherein when the attachment device is coupled to the support platform, the J-shaped hook end of the attachment device is coupled to the opening formed through the one horizontal crossmember that is positioned proximate the one end of the support platform and the T-shaped flat end of the attachment device is positioned flush against a sidewall of an adjacent horizontal crossmember.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

Figure 1:
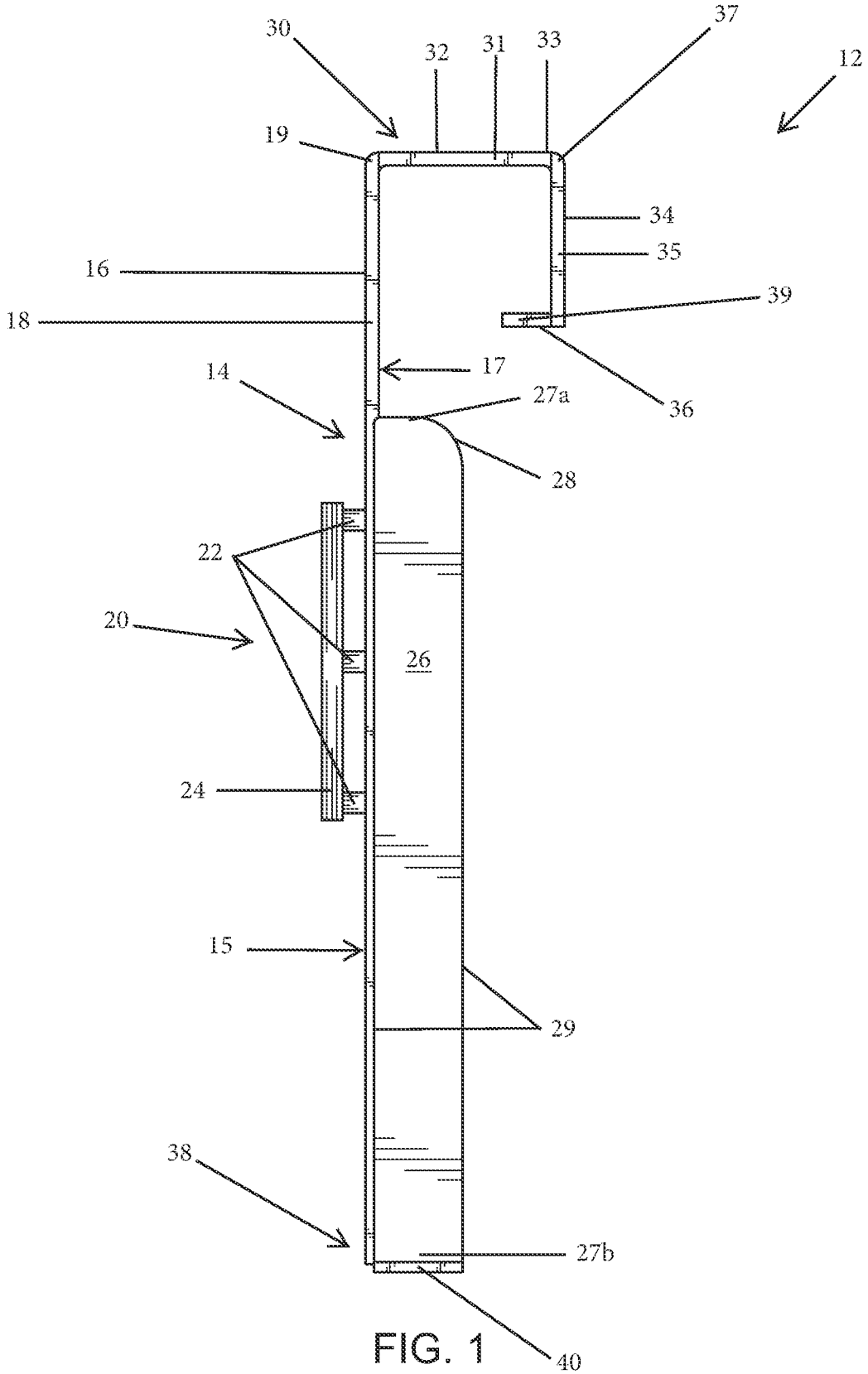
FIG. 1 is a side view of an attachment device in accordance with one or more embodiments of the present invention.
Figure 2:
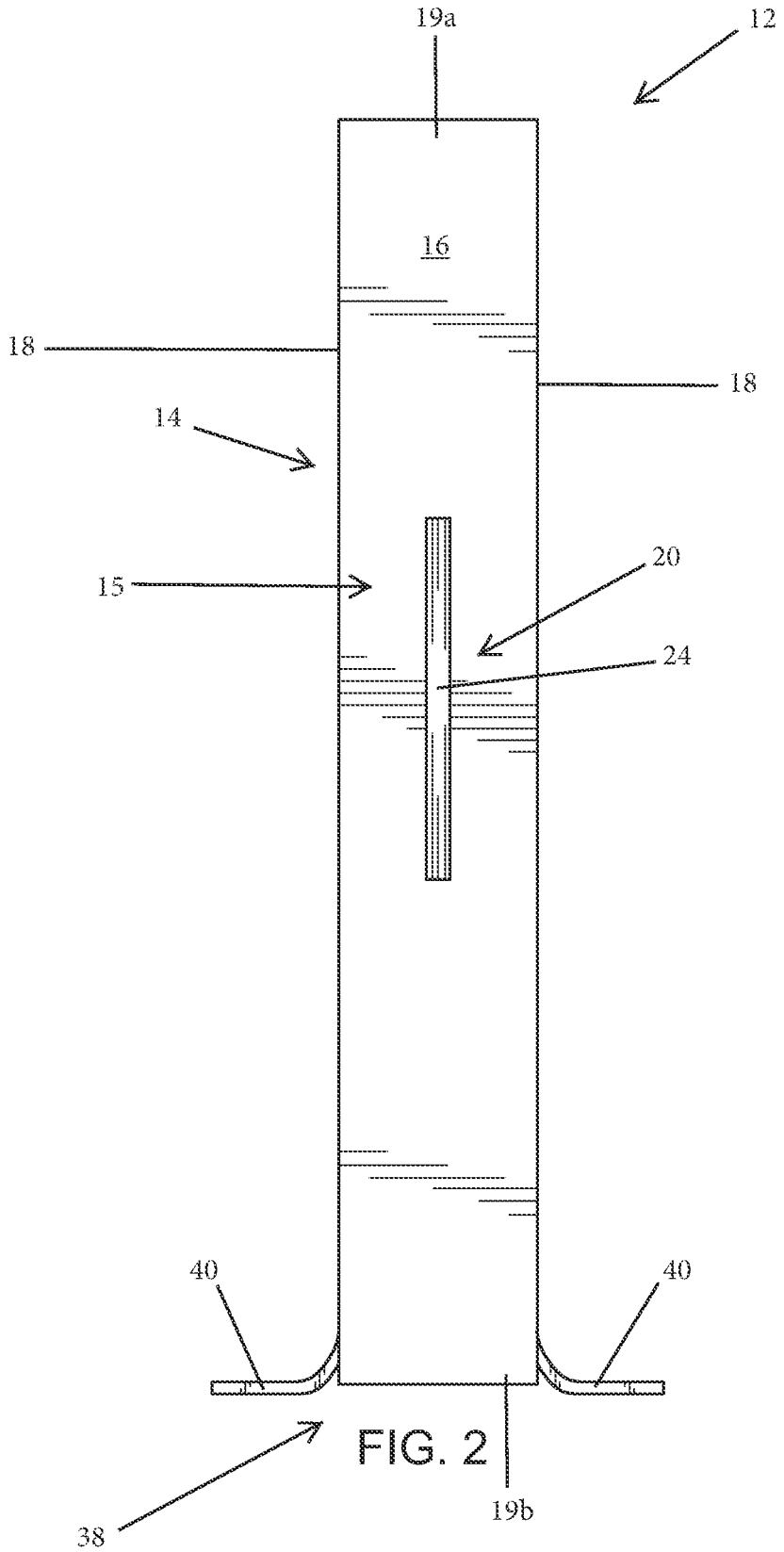
FIG. 2 is a front view of the attachment device of FIG. 1.
Figure 3:
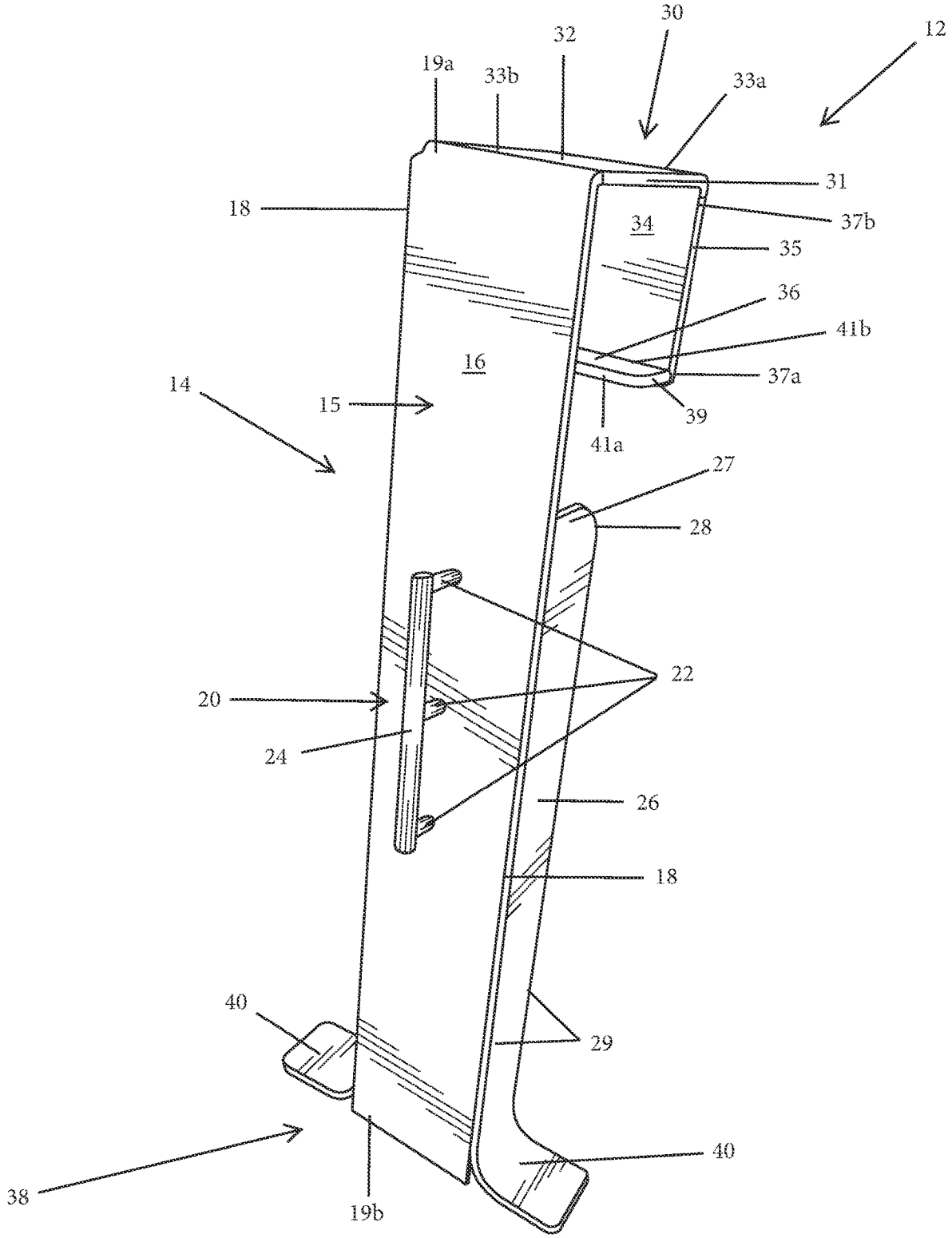
FIG. 3 is a front perspective view of the attachment device of FIG. 1.
Figure 4:
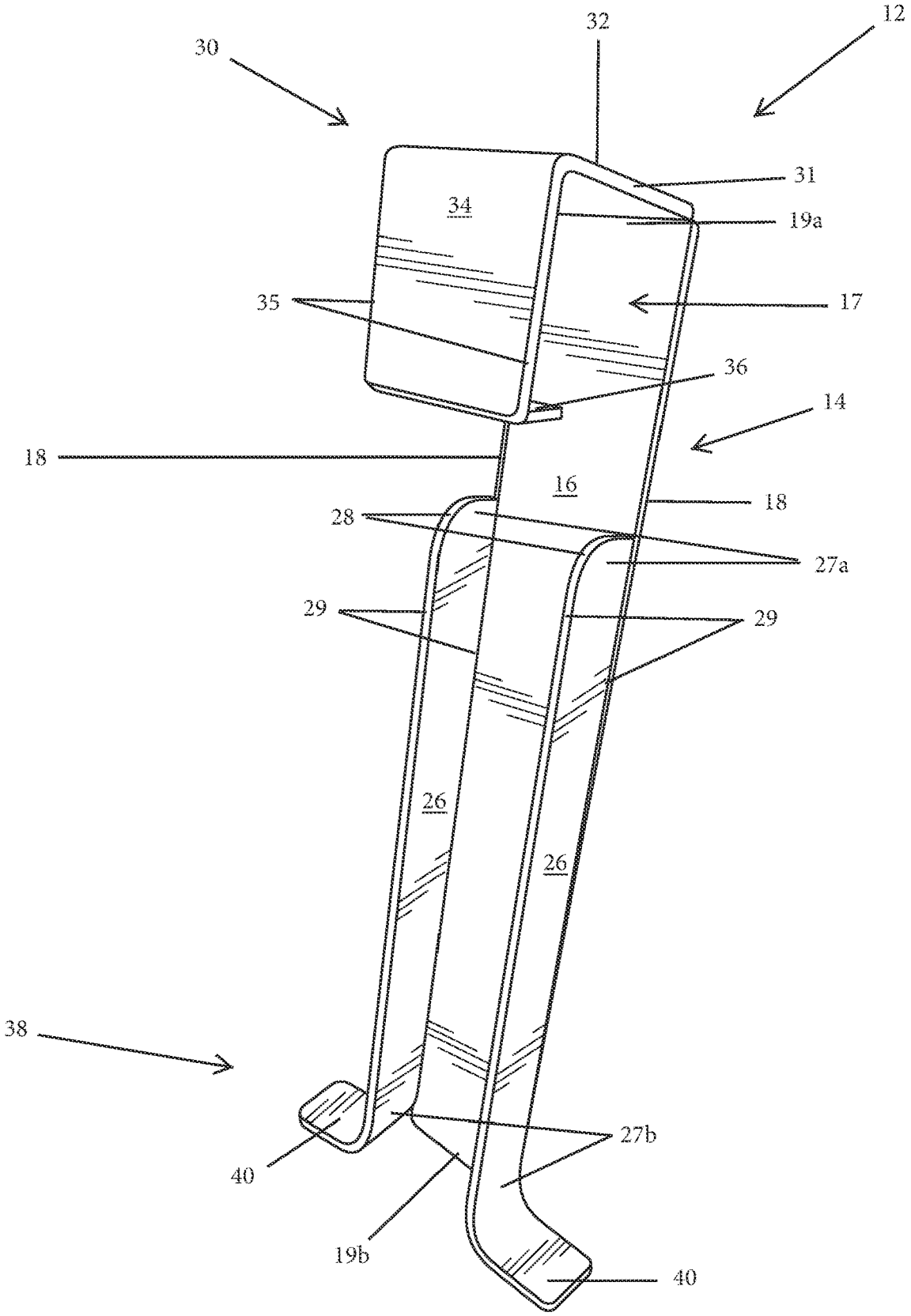
FIG. 4 is a rear perspective view of the attachment device of FIG. 1.

The description set forth below is intended as a description of presently preferred embodiments of the disclosure and is not intended to represent the only forms in which the present disclosure can be constructed and/or utilized. The description sets forth the functions and the sequence of steps for constructing and operating the disclosure. It is to be understood, however, that the same or equivalent functions and sequences can be accomplished by different embodiments that are also intended to be encompassed within the spirit and scope of this disclosure.

FIGS. 1-12 together disclose a roof jack attachment device 12 and system 10 that allows a roof jack 84 to be coupled to any type of roof 100. The system 10 in its simplest form comprises an attachment device 12 and a support platform 42. The support platform 42 may be similar to the support platform described and patented in U.S. Pat. No. 8,783,415 (hereinafter, "the '415 Patent"), which issued on Jul. 22, 2014 to the same inventor of the present invention. However, it should be clearly understood that substantial benefit may be obtained by using a support platform 42 as described herein and having an alternative structure than that disclosed in the '415 Patent.

FIGS. 1-4 together show the attachment device 12 in accordance with one or more embodiments of the present invention. The attachment device 12 has an elongated body 14, a J-shaped hook end 30, and a T-shaped flat end 38. The hook end 30 and the flat end 38 are disposed at opposite ends of the body 14 and may be integrally formed with the body 14. The attachment device 12 may be made of metal, plastic composite, or other suitable material.

The body 14 of the attachment device 12 has a front wall 16. The front wall 16 is rectangular in shape and has two oppositely disposed long side edges 18 and two oppositely disposed short end edges 19. According to one embodiment, the long side edges 18 may be about 12 inches (about 30.48 cm) long and the short end edges 19 may be about 2 inches (about 5.08 cm) long, but it should be clearly understood that the front wall 16 may have alternative dimensions, depending upon the shape of the horizontal crossmember 68 of the support platform 42 (discussed in detail below) to which the attachment device 12 will couple.

The body 14 also has two oppositely disposed side walls 26. One side wall 26 is coupled to or integral to one long side edge 18 of the front wall 16 and the other side wall 26 is coupled to or integral to the other long side edge 18 of the front wall 16. Each side wall 26 may be about 1 inch (about 2.54 cm) wide and each side wall 26 may be about 9 inches (about 22.86 cm) long, but it should be clearly understood that the side walls 26 may have alternative dimensions, depending upon the configuration of the support platform 42 (discussed in detail below) to which the attachment device 12 will couple. When one end 27*b* (referred to generically as end 27) of each side wall 26 is aligned with one short end edge 19*b* (referred to generically as short end edge 19) of the front wall 16, the side wall 26 measures about ¾ of the length of the long side edge 18 of the front wall 16. In the embodiment shown, the side walls 26 extend rearwardly and perpendicularly from the long side edges 18 of the front wall 16. It should be clearly understood, however, that substantial benefit may still be derived if the side walls 26 of the body 14 were positioned at an angle less than or greater than 90° with respect to the front wall 16, depending upon the shape of the cross-member 68 of the support platform 42 (discussed in detail below) to which the attachment device 12 will couple.

Each side wall 26 is substantially rectangular in shape and has a first short end edge 27*a* (referred to generically as end 27) and a second short end edge 27*b*, which are oppositely disposed. Each side wall 26 also has two oppositely disposed long side edges 29. One long side edge 29 of each side wall 26 extends perpendicularly from one long side edge 18 of the front wall 16. The other long side edge 29 of each side wall 26 is open/free standing; i.e. not coupled to or extending from anything. The first short end edge 27*a* of each side wall 26 is positioned proximate the hook end 30 of the attachment device 12 and the second short end edge 27*b* of each side wall 26 is positioned proximate the flat end 38 of the attachment device 12. Each of the short end edges 27*a* of the side walls 26, that are positioned proximate the hook end 30 of the attachment device 12, has a curved corner 28. This curved corner 28 is positioned on the long side edge 29 of the side wall 26 that is not coupled to the long side edge 18 of the front wall 16; i.e. positioned on the open/free standing long side edge 29 of the side wall 26. This curved corner 28 allows the attachment device 12 to be removably and hingedly coupled to the support platform 42 (discussed in detail below).

One curved foot 40 is coupled to and extends perpendicularly from the second short end edge 27*b* of each of the side walls 26. Positionally, if the front wall 16 extends vertically on the X axis, then the side walls 26 extend rearwardly along the Z axis, and the curved foot 40 extends horizontally long the Y axis. The two curved feet 40 are oppositely disposed from each other and extend laterally in opposite directions relative to the front wall 16 of the body 14 of the device 12. Together, the two curved feed 40 form the flat end 38 of the attachment device 12. The flat end 38 of the attachment device 12, made up of two curved feet 40 and the short end edge 19*b* of the front wall 16, may be about 4.5 inches (11.43 cm) long.

The hook end 30 of the attachment device 12 has a top wall 32, a rear wall 34, and a bottom wall 36. The top wall 32 extends rearwardly and perpendicularly from the short end edge 19*a* (referred to generically as short end edge 19) of the front wall 16. The top wall 32 has two oppositely disposed long side edges 31 that may be about 2.5 inches (about 6.35 cm) long and also has two oppositely disposed short end edges 33 that may be about 2 inches (about 5.08 cm) wide. The short end edge 33*b* (referred to generically as short end edge 33) of the top wall 32 is coupled to (or integral to) and forms a right angle with the short end edge 19*a* of the front wall 16 of the body 14 of the device 12.

The rear wall 34 extends downwardly and perpendicularly from the short end edge 33*a* (referred to generically as short end edge 33) of the top wall 32. The rear wall 34 is therefore positioned parallel to the front wall 16. The rear wall 34 has two oppositely disposed side edges 35 that are about 2 inches (about 5.08 cm) long and also has two oppositely disposed end edges 37 that may be about 2 inches (about 5.008 cm) wide. The end edge 37*b* (referred to generically as end edge 37) of the rear wall 34 is coupled to (or integral to) and forms a right angle with the short end edge 33*a* of the top wall 32.

The bottom wall 36 extends perpendicularly from the end edge 37*a* (referred to generically as end edge 37) of the rear wall 34 and extending forwardly toward the front wall 16 of the body 14 of the device 12. The bottom wall 36 has two oppositely disposed short side edges 39 that may be about 0.5 inch (about 1.27 cm) long and two oppositely disposed long end edges 41 that may be about 2 inches (about 5.08 cm) wide. The long end edge 41*b* (referred to generically as long end edge 41) of the bottom wall 36 is coupled to (or integral to) and forms a right angle with the end edge 37*a* of the rear wall 34. A space is therefore formed between the long end edge 41*a* (referred to generically as long end edge 41) of the bottom wall 36 and a rear surface 17 of the front wall 16.

A roof jack mount 20 is coupled to a front surface 15 of the front wall 16 of the body 14 of the device 12. The roof jack mount 20 is shown as having three prongs 22. It should be clearly understood that the roof jack mount 20 may have any suitable number of prongs 22, as long as there are enough prongs 22 to engage the number of slots 90 formed in the roof jack 84 that will be used. A first end of each prong 22 is coupled to and extends perpendicularly from the front surface 15 of the front wall 16. The prongs 22 are positioned in a single line along a length of the front surface 15 of the front wall 16 of the body 14 of the device 12. A bridge 24 is coupled to a second end of each of the prongs 22. Preferably, the prongs 22 are of equal length so that the bridge 24 is positioned perpendicularly to the prongs 22, while being positioned parallel to the front wall 16. It should be clearly understood substantial benefit may be derived from an attachment device 12 having alternative measurements than those described in the example above.

Referring to FIGS. 5-10, an embodiment of a support platform 42 that may be used in the present invention is shown. One embodiment of a support platform 42 that may be used with the attachment device 12 is the support platform that was disclosed in the '415 Patent, which is incorporated herein in full by reference. It should be clearly understood, however, that substantial benefit may be derived from the use of a support platform 42 as described herein and that differs in one or more aspects from that disclosed in the '415 Patent. The support platform 42 may be made of a resilient synthetic material that is easy to mold, such as polyethylene or a light metal allow, wood, or other suitable materials. The support platform 42 has a top surface 44 and a bottom surface 76. The support platform 42 may be rectangular in shape and thus may have two oppositely disposed long sides 46 and two oppositely disposed short ends 50. However, it should also be clearly understood that substantial benefit may still be derived from the support platform 42 having a square shape. The support platform 42 may also define two oppositely disposed openings 58 formed therethrough; one opening 58 is positioned proximate one short end 50 of the support platform 42 and the other opening 58 is positioned proximate the other short end 50 of the support platform 42. It should also be clearly understood that the support platform 42 may define one or more openings 58 positioned proximate one short end 50 of the support platform 42 and one or more openings 58 positioned proximate the other short end 50 of the support platform 42. It should also be clearly understood that substantial benefit may also be derived from the support platform 42 having one or more openings 58 positioned proximate only one short end 50 of the support platform 42.

A resilient pad 82 may be coupled to the bottom surface 76 of the support platform 42 via any suitable attachment means, such as but not limited to, a strong adhesive. Resilient pad 82 will cover the bottom surface 76 of the support platform 42 except for the openings 58; the openings 58 must be left completely open and uncovered as these openings 58 may be used for coupling the hook end 30 of an attachment device 12 thereto or these openings 58 may be used to couple one support platform 42 to another support platform 42. Resilient pad 82, which may include an underside having a generally flat, convex, or concave configuration and/or embody some sort of textured, uneven, or crater-like surface, is comprised of a conformable material, such as polyethylene foam or rubber. The resilient pad 82 must be made of material with gripping capabilities to ensure maximum frictional engagement with the roof 100 surface. The resilient pad 82 is provided for substantially conforming to the shape and contours of the underlying surface, whether the surface is sloped or generally level, or exists within, on top of, or outside of a building, or any other type of structure. The support platform 42 with the resilient pad 82 receive and distribute weight loads over the top surface 44 of the support platform 42 to protect against damage to the underlying roof surface 100 and to provide a frictional base to hold support platform 42 securely to the underlying roof surface 100.

Figure 5:
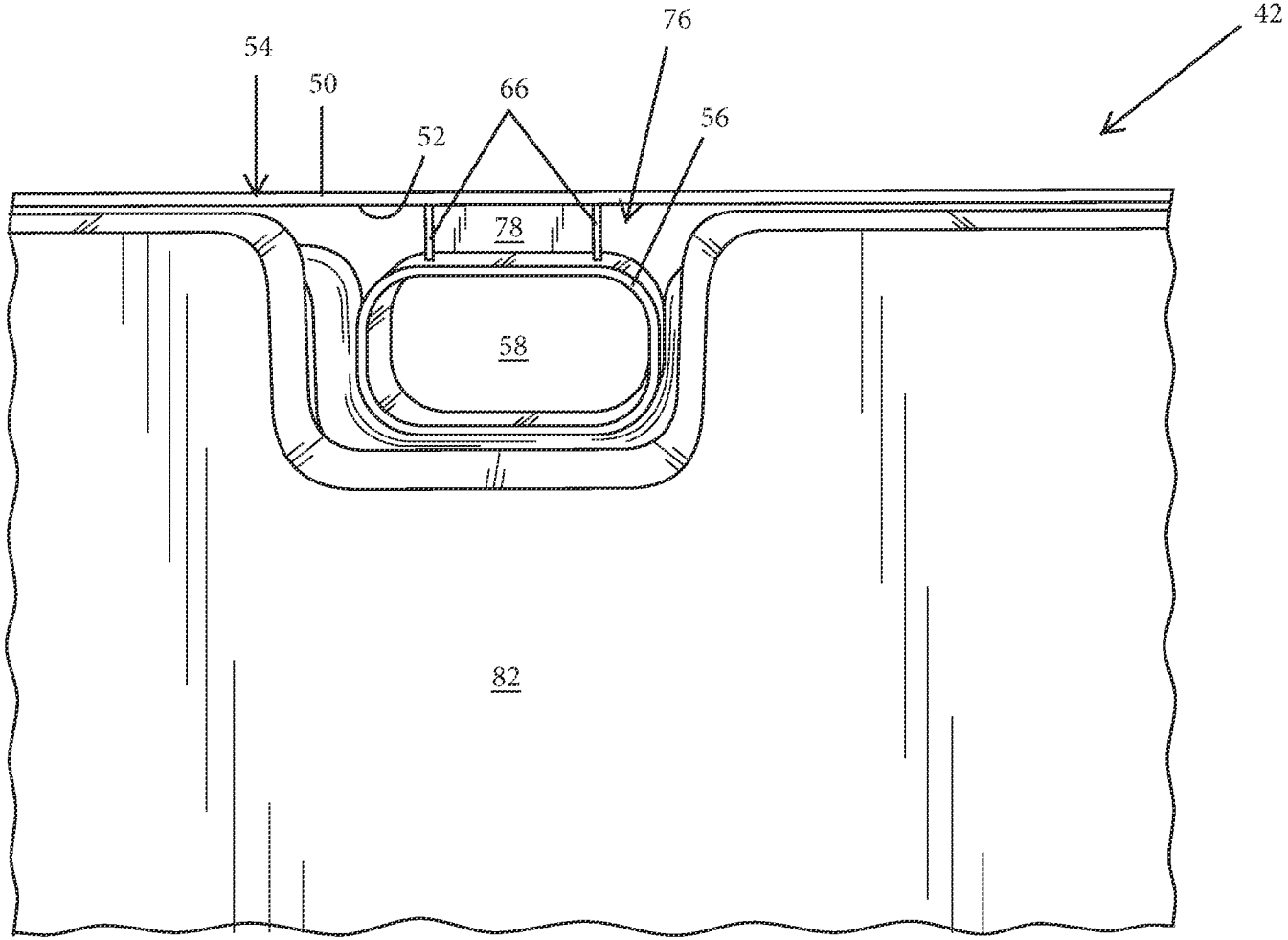
FIG. 5 is a partial rear view of a support platform in accordance with one or more embodiments of the present invention.
Figure 6:
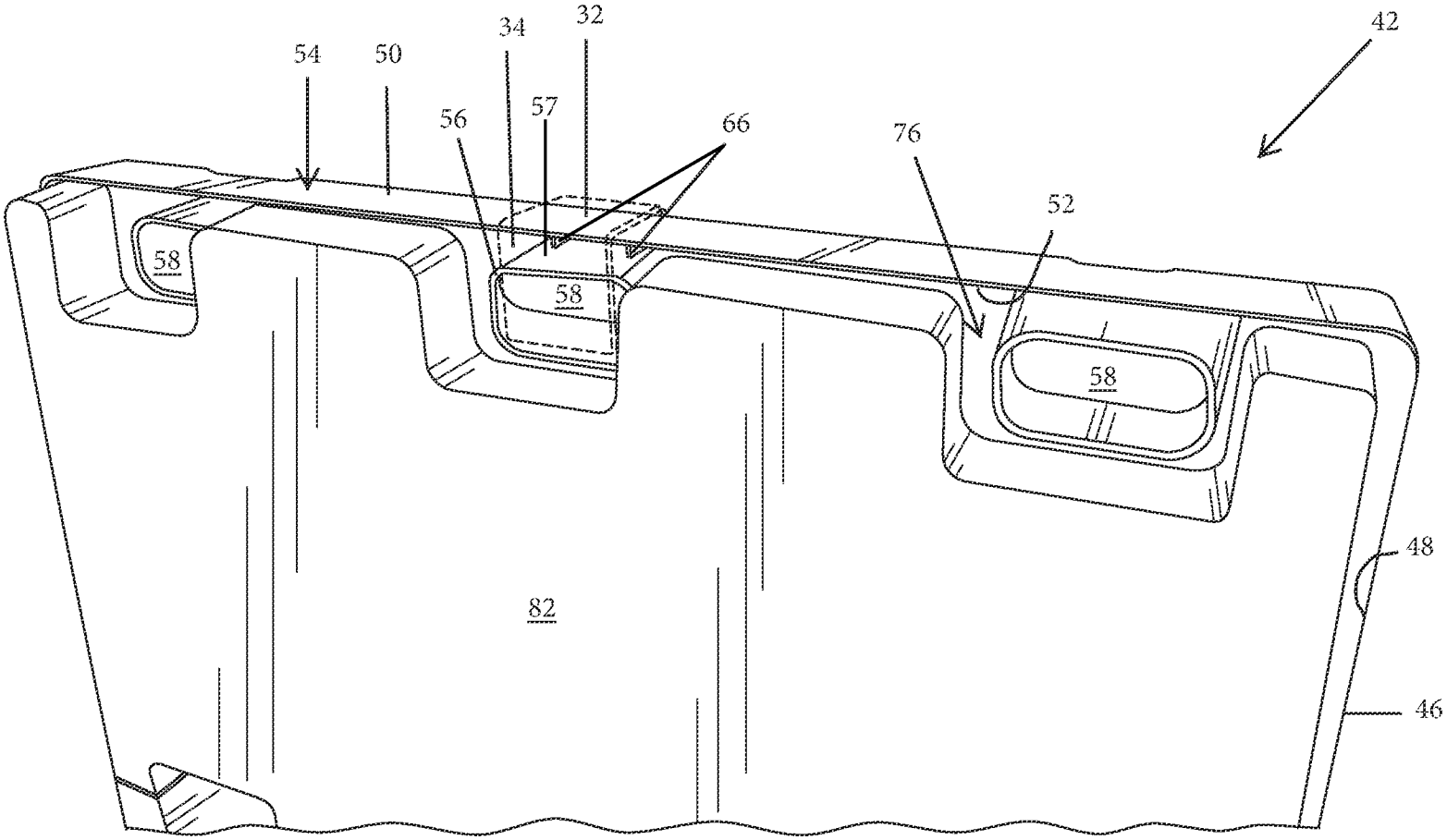
FIG. 6 is a partial rear view of the support platform of FIG. 5 shown with an attachment device coupled thereto.
Figure 7:
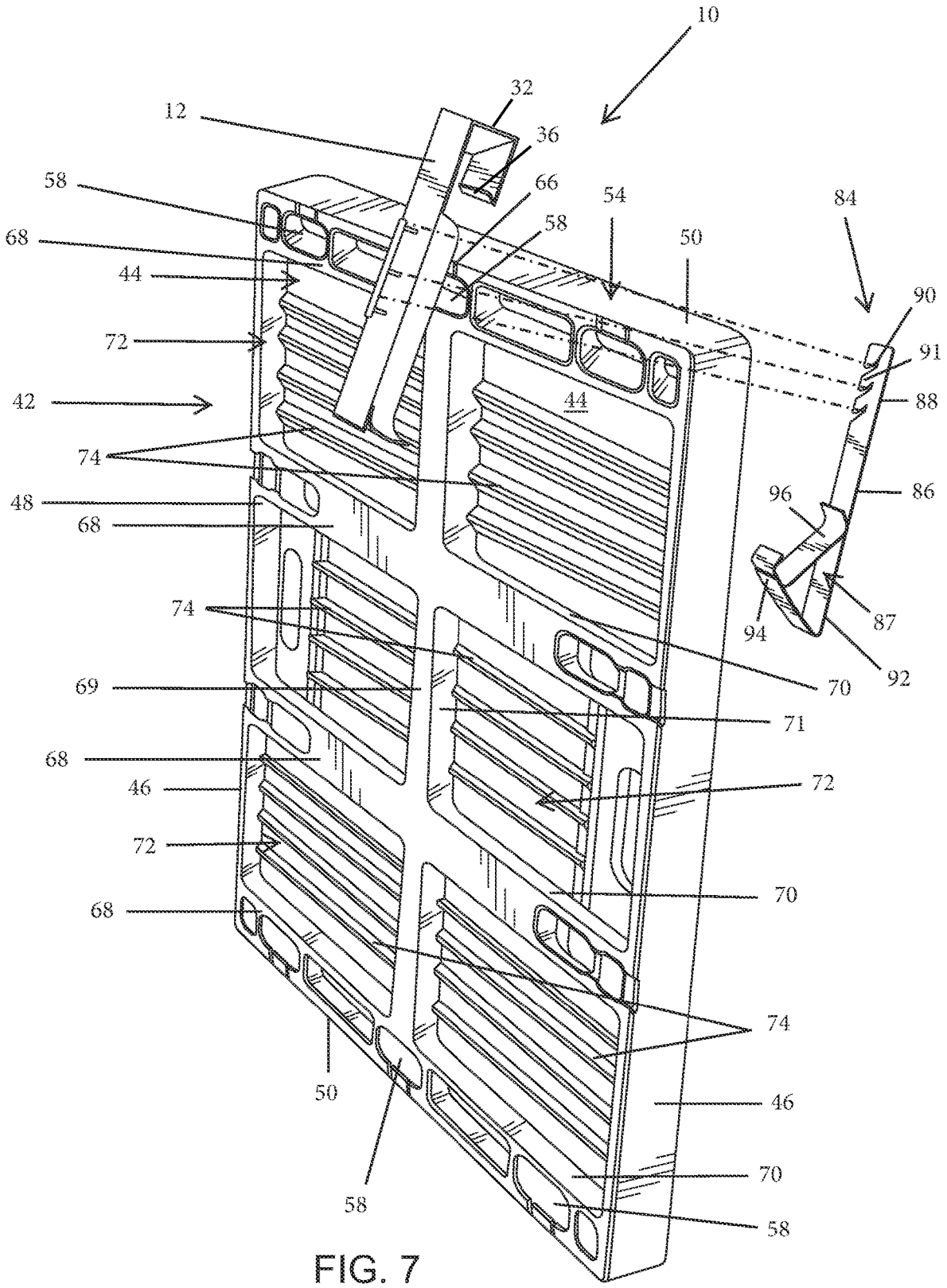
FIG. 7 is an exploded front perspective view of the attachment device of FIG. 1, the support platform of FIG. 5, and a roof jack.
Figure 8:
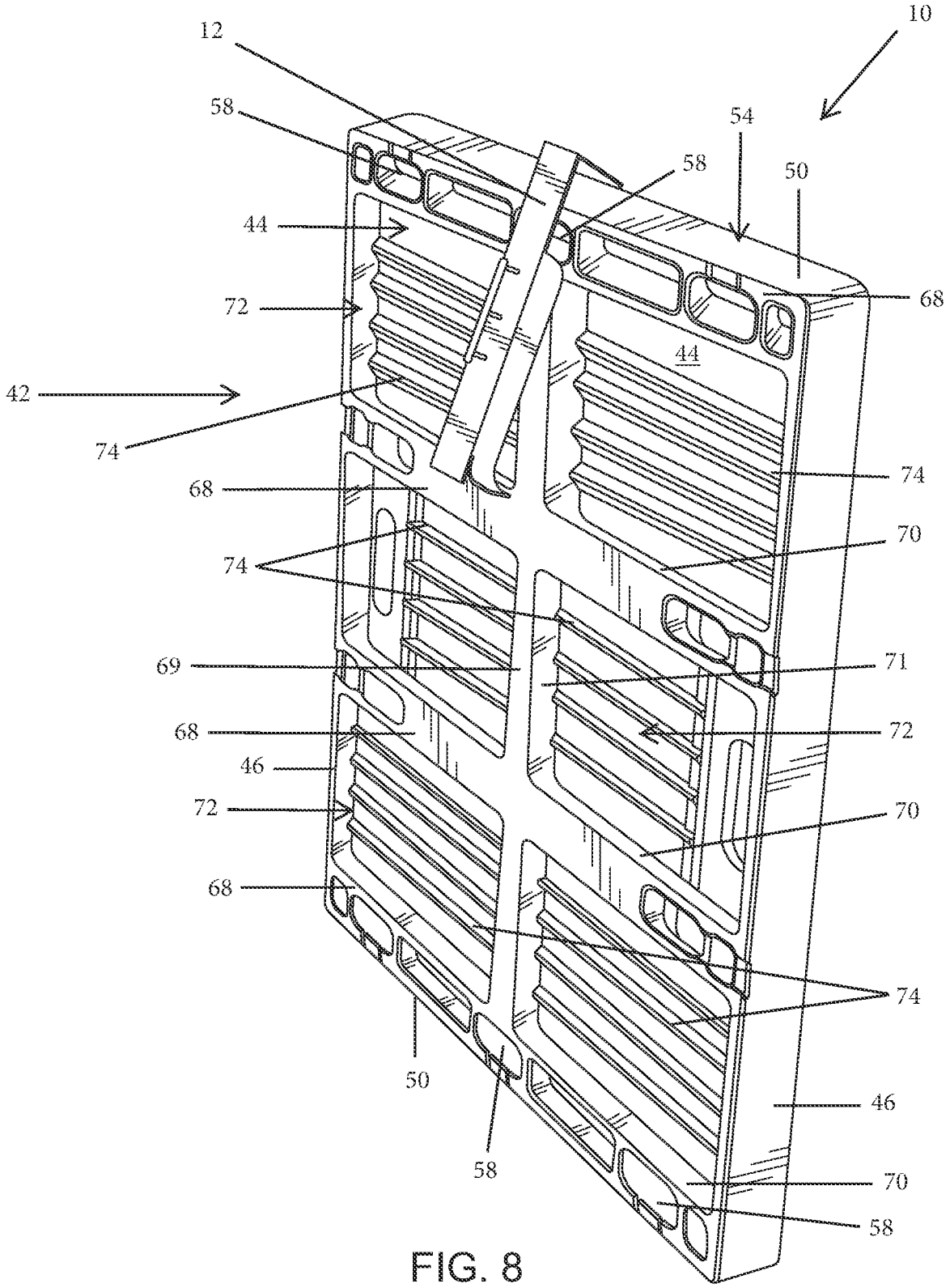
FIG. 8 is a front perspective view of the attachment device of FIG. 1 partially coupled to the support platform of FIG. 5.
Figure 9:
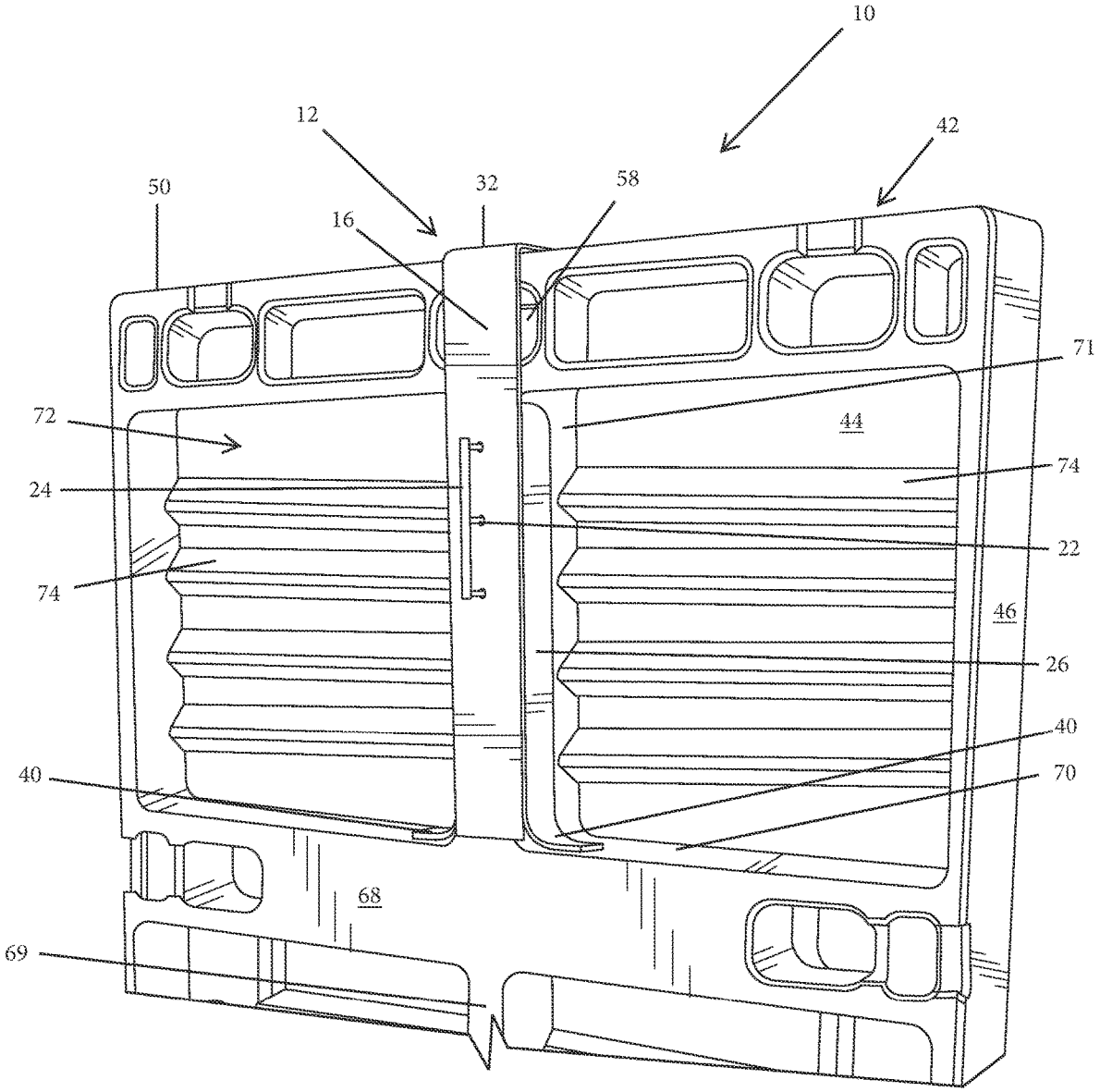
FIG. 9 is a partial front perspective view of the attachment device of FIG. 1 fully coupled to the support platform of FIG. 5.

FIGS. 5-6 show the support platform 42 with the resilient pad 82 coupled to its bottom surface 76. As shown, the hook end 30 of the attachment device 12 removably and hingedly couples to the opening 58 that is positioned proximate one of the short ends 50 of the support platform 42 and that is positioned at a midpoint of the width of the support platform 42. The opening 58 is dimensioned to receive and secure the hook end 30 of the attachment device 12. In this embodiment where there are three openings 58 positioned proximate one of the short ends 50 of the support platform 42, the hook end 30 of the attachment device 12 is shown coupled to the opening 58 that is positioned at a midpoint of the width of the support platform 42. In some embodiments, there may be one or more support members 66 coupled to the bottom surface 76 of the support platform 42 and positioned within a gap 78 formed between a perimeter wall 57 of the opening 58 and the interior surface 52 of the short end 50 proximate the opening 58. These support members 66 help to maintain the structural integrity of the opening 58 when the hook end 30 of the attachment device 12 is coupled thereto. It should be clearly understood that substantial benefit may still be obtained from the use of more than two support members 66, less than two support members 66, or no support members 66.

When the attachment device 12 is fully coupled to the support platform 42, the hook end 30 of the attachment device 12 engages the opening 58 of the support platform 42. The top wall 32 of the hook end 30 will be positioned flush against the exterior surface 54 of the short end 50. The rear wall 34 of the hook end 30 will be positioned flush against a portion of the bottom edge 56 of the opening 58 that is positioned more proximate to the short end 50. In an embodiment that has support members 66, the rear wall 34 of the hook end 30 would be positioned over the support members 66 and the gap 78. The bottom wall 36 of the hook end 30 will be positioned within the opening 58. Preferably, the top wall 32, the rear wall 34, and the bottom wall 36 will have a width similar to the width of the opening 58 to which it is coupled, thus limiting the amount of lateral movement of the hook end 30 within the opening 58. The hook end of the attachment device 12 should be sized and configured to create a friction fit with the opening 58 of the support platform 42.

FIGS. 7-10 show additional details about the support platform 42. The support platform 42 is shown as having a plurality of horizontal crossmembers 68 formed on the top surface 44. In this embodiment, there are four horizontal crossmembers 68 that are equally spaced apart along the length of the support platform 42. The horizontal crossmembers 68 are coupled to (or are integral with) and extend from the interior surface 48 of one long side 46 of the support platform 42 to the interior surface 48 of the other long side 46 of the support platform 42. The openings 58 are shown as being formed within the horizontal crossmembers 68 that are positioned most proximate to the two oppositely disposed short ends 50 of the support platform 42. The support platform 42 is also shown as having a vertical crossmember 69 formed on the top surface 44. The vertical crossmember 69 is shown as being positioned along a midpoint of the width of the support platform 42. The vertical crossmember 69 is coupled to (or is integral with) and extends from the horizontal crossmember 68 proximate one short end 50 of the support platform 42 to the other horizontal crossmember 68 proximate the other oppositely disposed short end 50 of the support platform 42.

The four horizontal crossmembers 68 and the one vertical crossmember 69 together form six recessed areas 72 on the top surface 44 of the support platform 42. These recessed areas 72 are formed by the sidewalls 70 of the horizontal crossmembers 68 and the sidewalls 71 of the vertical crossmember 69. These recessed areas 72 are intended to receive the feet of a user 102 that is standing on the support platform 42. Each of the recessed areas 72 has a plurality of horizontally disposed ribs 74 formed therein. The horizontally disposed ribs 74 are coupled to (or are integral with) and extend perpendicularly and upwardly from the top surface 44 of the support platform 42. These ribs 74 are shown as extending the entire horizontal width of their respective recessed areas 72. These ribs 74 may be triangular-shaped or rectangular-shaped and they help to provide the user's 102 feet with more stable footing while walking or standing upon the support platform 42.

When the attachment device 12 is being coupled to the support platform 42, the hook end 30 of the attachment device 12 engages an opening 58 of the support platform 42. The preferred opening 58 is shown as being positioned at a midpoint of the width of the support platform 42 and is shown as being formed within the horizontal crossmembers 68 that is most proximate one of the short ends 50 of the support platform 42. The bottom wall 36 of the hook end 30 of the attachment device 12 is inserted through the opening 58 from the direction of the bottom surface 76 of the support platform 42. The attachment device 12 is then lowered in a hinge motion onto the short end 50 until the top wall 32 of the hook end 30 of the attachment device 12 is positioned flush against the exterior surface 54 of the short end 50 of the support platform 42 and until the curved feet 40 of the flat end 38 of the attachment device 12 are positioned flush against a sidewall 70 of the next adjacent horizontal crossmember 68. The length of the body 14 of the attachment device 12 should be of similar length as the distance between the exterior surface 54 of the short end 50 of the support platform 42 to the sidewall 70 of the next adjacent horizontal crossmember 68 to create a friction fit between the hook end 30 of the attachment device 12 with the opening 58 at one short end 50 of the support platform 42 and a friction fit between the flat end 38 of the attachment device 12 with the sidewall 70 of the next adjacent horizontal crossmember 68. Furthermore, when the attachment device 12 is being coupled to the support platform, the sidewalls 26 of the body 14 of the attachment device 12 are positioned flush against the two oppositely disposed sidewalls 71 of the vertical crossmember 69. The width of a gap formed between the sidewalls 26 of the body 14 of the attachment device 12 should be similar to the width of the vertical crossmember 69 in order to create a friction fit between the sidewalls 26 of the attachment device 12 and the vertical crossmember 69. The curved corners 28 of the sidewalls 26 of the body 14 of the attachment device 12 allow the attachment device 12 to be smoothly lowered in a hinge motion onto the vertical crossmember 69 of the support platform 42.

Figure 10:
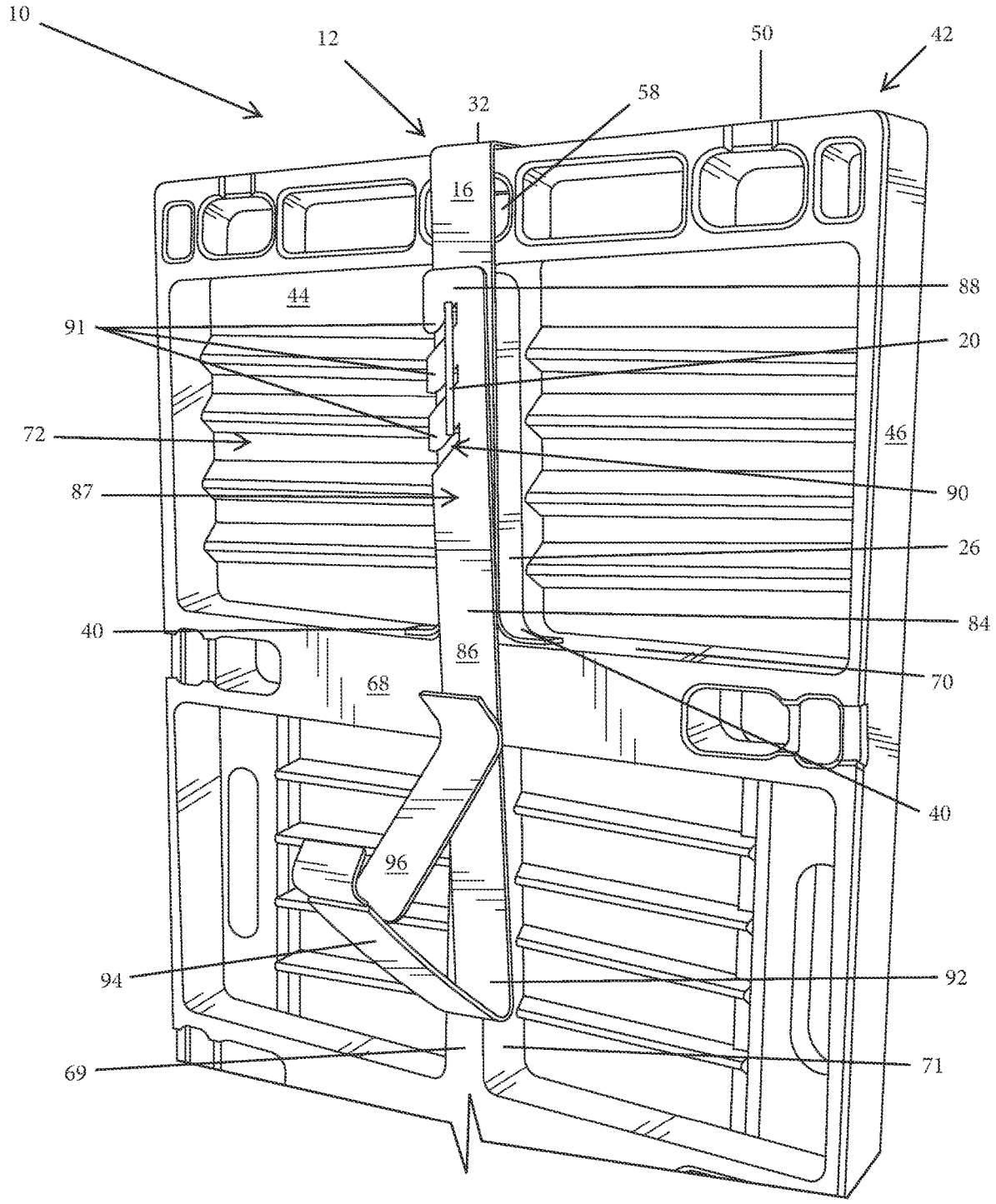
FIG. 10 is a partial front perspective view of the attachment device of FIG. 1, the support platform of FIG. 5, and a roof jack fully coupled together.

Once the attachment device 12 is securely coupled to the support platform 42, a roof jack 84 may be coupled to the attachment device 12 as shown in FIG. 10. A standard roof jack 84 typically has a body 86 and a plurality of hooks 91 integrally formed on the body 86 and positioned proximate a first end 88 of the body 86. In between each two adjacent hooks 91 is therefore formed a slot 90. The slots 90 are typically spaced about 1.5 inches (about 2.54 cm) apart. The roof jack 84 also has a second end 92 oppositely disposed from the first end 88 and an L-shaped hook 94 is coupled to the second end 92. The roof jack 84 also has a U-shaped platform 96 having one end coupled to a front surface 87 of the body 86 and an oppositely disposed end coupled to the L-shaped hook 94. The U-shaped platform 96 is sized and configured to receive and support a wooden beam 98 therein. Oftentimes, the wooden beam 98 may be a 2 in x 6 in beam or a 2 in x 8 in beam. The angle of the U-shaped platform 96 relative to the body 86 of the roof jack 84 may vary between a 45°, 60°, or 90° angle, depending on the slope of the roof 100. As shown, the three prongs 22 of the roof jack mount 20 on the front wall 16 of the attachment device 12 are aligned with and inserted into the corresponding three slots 90 formed within the body 86 of the roof jack 84. Therefore, the prongs 22 should have a diameter similar to the width of the slots 90 of the roof jack 84. The bridge 24 of the roof jack mount 20 prevents the three prongs 22 of the roof jack mount 20 from sliding in a perpendicular direction through the three slots 90 within the body 86 of the roof jack 84 thus helping to prevent detachment of the roof jack 84 from the attachment device 12.

Figure 11:
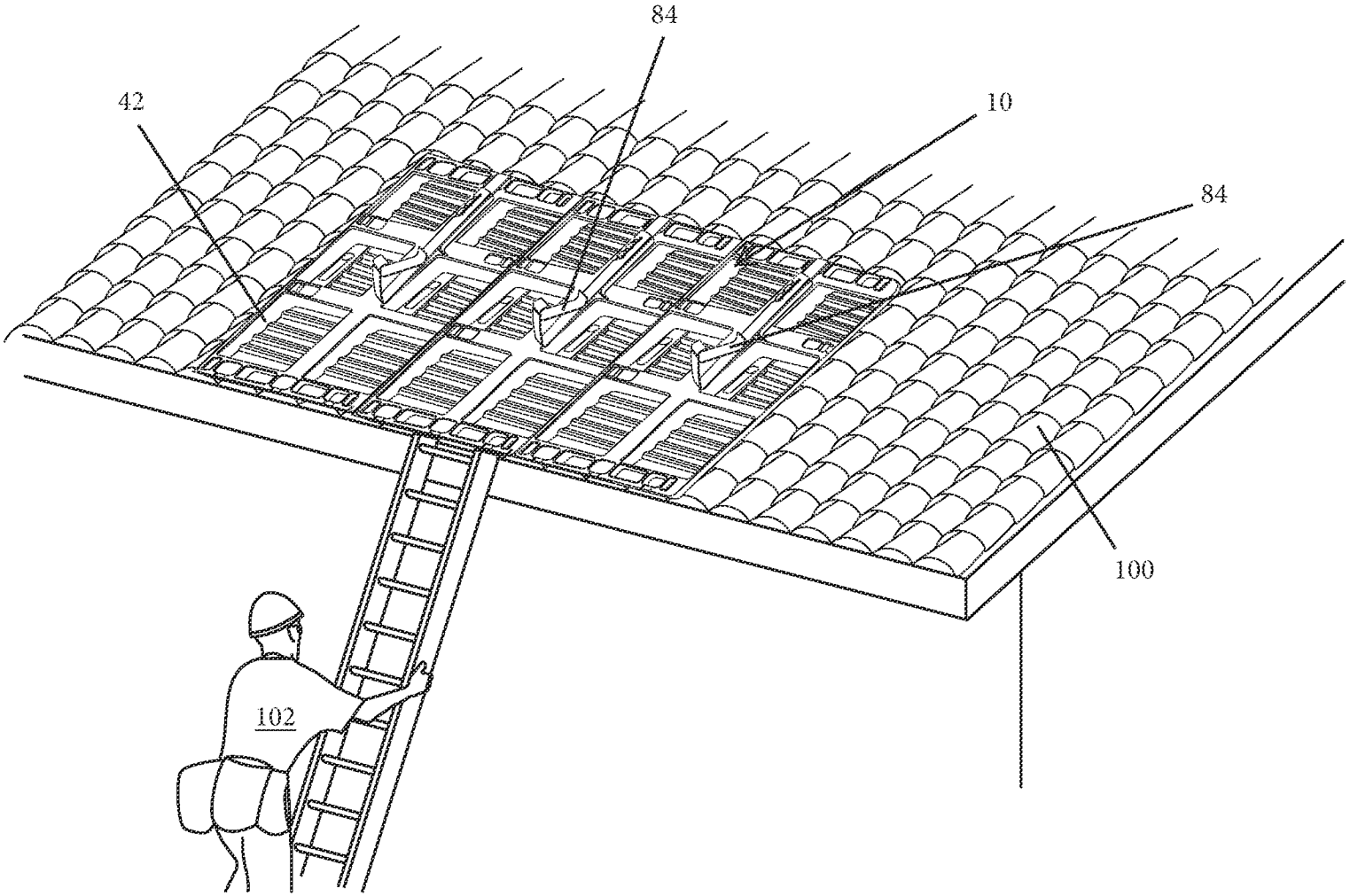
FIG. 11 is an elevated perspective view of the support system of the present invention coupled to a roof.
Figure 12:
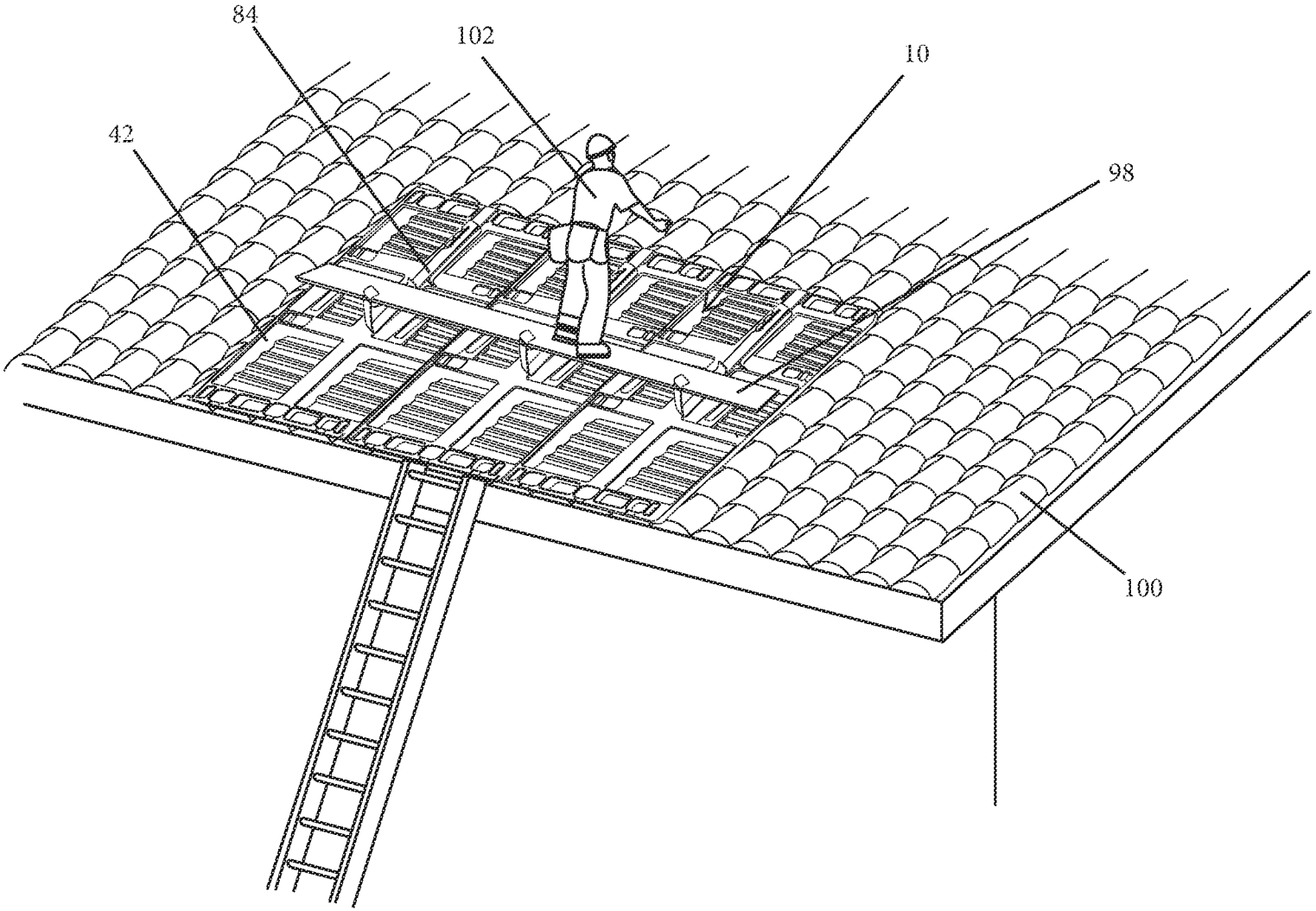
FIG. 12 is an elevated perspective view of the support system of the present invention coupled to a roof and in use.

FIGS. 11-12 show a plurality of the attachment devices 12 and systems 10 being used on a sloped roof 100. The support platforms 42 must be placed on the roof 100 so that at least two attachment devices 12 may be positioned side-by-side. The support platforms 42 may be aligned in a normal or perpendicular relationship. Once the attachment devices 12 are in place, a roof jack 84 may be coupled to each attachment device 12. A wooden beam 98 may them be inserted into the U-shaped platforms 96 of the side-by-side attachment devices 12 to create a level platform for the user to stand on.

The foregoing description is illustrative of particular embodiments of the application, but it is not meant to be limitation upon the practice thereof. While embodiments of the disclosure have been described in terms of various specific embodiments, those skilled in the art will recognize that the embodiments of the disclosure may be practiced with modifications within the spirit and scope of the claims.

I claim:

1. A roof jack attachment device for use with a support platform, the attachment device comprising:

a body, the body comprising:

a rectangular front wall having two oppositely disposed long side edges and two oppositely disposed short end edges; and two side walls, each side wall extending rearwardly and perpendicularly from one of the long side edges of the front wall of the body, each side wall of the body comprising:

a first long side edge extending perpendicularly from one long side edge of the front wall;

a second long side edge;

a first short end edge having a curved corner positioned proximate the second long side edge; and a second short end edge;

wherein a length of the side walls is ¾ of a length of the long side edges of the front wall;

a hook end disposed at one end of the body;

a flat end disposed at an opposite end of the body;

a roof jack mount coupled to the body;

one curved foot extending perpendicularly from the second short end edge of one side wall of the body; and another curved foot extending perpendicularly from the second short end edge of another side wall of the body, wherein the two curved feet are oppositely disposed from each other and extend laterally in opposing directions relative to the front wall of the body of the attachment device, and wherein the two curved feet together form the flat end of the body.

2. The attachment device of claim 1, further comprising:

a top wall extending rearwardly and perpendicularly from one short end edge of the front wall of the body;

a rear wall extending downwardly and perpendicularly from the top wall; and a bottom wall extending perpendicularly from the rear wall and extending forwardly toward the front wall of the body, wherein the top wall, the rear wall, and the bottom wall together form the hook end of the body.

3. The attachment device of claim 1, wherein the roof jack mount is coupled to a front surface of the front wall of the body, the roof jack mount comprising:

at least three prongs, each prong having a first end coupled to and extending perpendicularly from the front surface of the front wall of the body; and a bridge coupled to a second end of each of the prongs, the bridge being coupled in a perpendicular position relative to the at least three prongs.

4. The attachment device of claim 1, wherein the support platform comprises:

a top surface;

a bottom surface with a resilient pad coupled thereto;

two oppositely disposed sides;

two oppositely disposed ends; and at least one opening formed therethrough, the opening positioned proximate one end, wherein the opening is dimensioned to receive and secure the hook end of the attachment device.

5. The attachment device of claim 4, wherein the support platform further comprises:

a gap formed between a perimeter wall of the opening and an interior surface of the one end; and at least one support member coupled to the bottom surface of the support platform, the support member being positioned within the gap.

6. The attachment device of claim 4, wherein the hook end has a width equal to a width of the opening formed through the support platform.

7. The attachment device of claim 4, wherein the support platform further comprises:

a plurality of horizontal crossmembers formed on the top surface of the support platform, the horizontal crossmembers extending from an interior surface of one side of the support platform to an interior surface of the other side of the support platform; and a vertical crossmember formed on the top surface of the support platform, the vertical crossmember extending from one horizontal crossmember proximate one end of the support platform to another horizontal crossmember proximate the other end of the support platform, wherein the plurality of horizontal crossmembers and the vertical crossmember together form a plurality of recessed areas on the top surface of the support platform.

8. A roof jack attachment device for use with a support platform, the attachment device comprising:

an elongated body, the body comprising:

a rectangular front wall having two oppositely disposed long side edges and two oppositely disposed short end edges; and two side walls, each side wall extending rearwardly and perpendicularly from one of the long side edges of the front wall of the body and each side wall comprising:

a first long side edge extending perpendicularly from one long side edge of the front wall;

a free-standing second long side edge;

a first short end edge having a curved corner positioned proximate the free-standing second long side edge; and a second short end edge, wherein a length of the side walls is ¾ of a length of the long side edges of the front wall;

a J-shaped hook end disposed at one end of the body;

a T-shaped flat end disposed at an opposite end of the body; and a roof jack mount coupled to the body;

one curved foot extending perpendicularly from the second short end edge of one side wall of the body; and another curved foot extending perpendicularly from the second short end edge of another side wall of the body, wherein the two curved feet are oppositely disposed from each other and extend laterally in opposing directions relative to the front wall of the body of the attachment device, and wherein the two curved feet together form the T-shaped flat end of the body:

the support platform having a rectangular shape and comprising:

a top surface;

a bottom surface with a resilient pad coupled thereto;

two oppositely disposed long sides;

two oppositely disposed short ends; and at least one opening formed through the support platform, the opening positioned proximate one short end, wherein the opening is dimensioned to receive and secure the J-shaped hook end of the attachment device.

9. The attachment device of claim 8, further comprising:
a top wall extending rearwardly and perpendicularly from one short end edge of the front wall of the body;
a rear wall extending downwardly and perpendicularly from the top wall; and
a bottom wall extending perpendicularly from the rear wall and extending forwardly toward the front wall of the body, wherein the top wall, the rear wall, and the bottom wall together form the J-shaped hook end of the body.

10. The attachment device of claim 8, the roof jack mount comprising:
at least three prongs, each prong having a first end coupled to and extending perpendicularly from a front surface of the front wall of the body; and
a bridge coupled to a second end of each of the prongs, the bridge being coupled in a perpendicular position relative to the at least three prongs.

11. The attachment device of claim 8, wherein the support platform further comprises:
a plurality of horizontal crossmembers formed on the top surface of the support platform, the horizontal crossmembers extending from an interior surface of one side of the support platform to an interior surface of the other side of the support platform;
a vertical crossmember formed on the top surface of the support platform, the vertical crossmember extending from one horizontal crossmember proximate one end of the support platform to another horizontal crossmember proximate the other end of the support platform; and
at least one opening formed through the support platform and positioned proximate one end, wherein the opening is dimensioned to receive and secure the hook end of the attachment device,
wherein the plurality of horizontal crossmembers and the vertical crossmember together form a plurality of recessed areas on the top surface of the support platform.

12. The attachment device of claim 11, wherein the support platform further comprises:
a gap formed between a perimeter wall of the opening and an interior surface of the one end of the support platform; and
at least one support member coupled to the bottom surface of the support platform, the support member being positioned within the gap.

13. The attachment device of claim 11, wherein a gap formed between the sidewalls of the body of the attachment device has a width equal to a width of the vertical crossmember of the support platform to create a friction fit between the sidewalls of the body and the vertical crossmember of the support.

14. The attachment device of claim 13, wherein when the attachment device is coupled to the support platform, the J-shaped hook end of the attachment device is coupled to the opening formed at one end of the support platform and the T-shaped flat end of the attachment device is positioned flush against a sidewall of an adjacent horizontal crossmember.

15. A support system for a roof jack comprising:
an attachment device comprising:
an elongated body;
a J-shaped hook end disposed at one end of the body;
a T-shaped flat end disposed at an opposite end of the body; and
a roof jack mount coupled to the body; and
a support platform having a rectangular shape and comprising:
a top surface;
a bottom surface with a resilient pad coupled thereto;
two oppositely disposed long sides;
two oppositely disposed short ends;
four horizontal crossmembers formed on the top surface of the support platform, the horizontal crossmembers extending from an interior surface of one side of the support platform to an interior surface of the other side of the support platform;
one vertical crossmember formed on the top surface of the support platform, the vertical crossmember extending from one horizontal crossmember proximate one end of the support platform to another horizontal crossmember proximate the other end of the support platform;
six recessed areas on the top surface of the support platform, six recessed areas formed by the four horizontal crossmembers and the vertical crossmember together; and
at least one opening formed through one horizontal crossmember that is positioned proximate one short end, wherein the opening is dimensioned to receive and secure the J-shaped hook end of the attachment device,
wherein when the attachment device is coupled to the support platform, the J-shaped hook end of the attachment device is coupled to the opening formed through the one horizontal crossmember that is positioned proximate the one end of the support platform and the T-shaped flat end of the attachment device is positioned flush against a sidewall of an adjacent horizontal crossmember.

16. A roof jack attachment device for use with a support platform, the attachment device comprising:
a body, the body comprising;
a rectangular front wall having two oppositely disposed long side edges and two oppositely disposed short end edges; and
two side walls, each side wall extending rearwardly and perpendicularly from one of the long side edges of the front wall of the body and each side wall comprising:
a first long side edge extending perpendicularly from one long side edge of the front wall;
a second long side edge;
a first short end edge positioned proximate the second long side edge; and
a second short end edge;
a hook end disposed at one end of the body;
a flat end disposed at an opposite end of the body, the flat end being formed by:
one curved foot extending perpendicularly from the second short end edge of one side wall of the body; and
another curved foot extending perpendicularly from the second short end edge of another side wall of the body,
wherein the two curved feet are oppositely disposed from each other and extend laterally in opposing directions relative to the front wall of the body of the attachment device; and
a roof jack mount coupled to the body.

17. The attachment device of claim 16, wherein a length of the side walls is ¾ of a length of the long side edges of the front wall.

18. The attachment device of claim 16, wherein the support platform comprises:

a top surface;

a bottom surface with a resilient pad coupled thereto;

two oppositely disposed sides;

two oppositely disposed ends; and at least one opening formed therethrough, the opening positioned proximate one end, wherein the opening is dimensioned to receive and secure the hook end of the attachment device.

19. The attachment device of claim 18, wherein the support platform further comprises:

a plurality of horizontal crossmembers formed on the top surface of the support platform, the horizontal crossmembers extending from an interior surface of one side of the support platform to an interior surface of the other side of the support platform; and a vertical crossmember formed on the top surface of the support platform, the vertical crossmember extending from one horizontal crossmember proximate one end of the support platform to another horizontal crossmember proximate the other end of the support platform, wherein the plurality of horizontal crossmembers and the vertical crossmember together form a plurality of recessed areas on the top surface of the support platform.

20. The attachment device of claim 16, wherein the roof jack mount is coupled to a front surface of the front wall of the body, the roof jack mount comprising:

at least three prongs, each prong having a first end coupled to and extending perpendicularly from the front surface of the front wall of the body; and a bridge coupled to a second end of each of the prongs, the bridge being coupled in a perpendicular position relative to the at least three prongs.

* * * * *